United States Patent [19]

Ohba et al.

[11] 4,298,489

[45] Nov. 3, 1981

[54] PHOSPHATE ESTER-BASED FIRE RESISTANT HYDRAULIC FLUID CONTAINING AN ALIPHATIC POLYESTER

[75] Inventors: Kenjiro Ohba, Osaka; Kaichi Izumi, Tokyo; Shinichiro Yasuda, Wakayama, all of, Japan

[73] Assignee: Kao Soap Co., Ltd., Tokyo, Japan

[21] Appl. No.: 52,746

[22] Filed: Jun. 28, 1979

Related U.S. Application Data

[63] Continuation of Ser. No. 879,962, Feb. 21, 1978, abandoned.

[30] Foreign Application Priority Data

Feb. 25, 1977 [JP] Japan ..... 52-20113

[51] Int. Cl.[3] ..... C10M 3/40

[52] U.S. Cl. ..... 252/78.5

[58] Field of Search ..... 252/78.5, 77, 49.8

[56] References Cited

U.S. PATENT DOCUMENTS

| | | | |
|---|---|---|---|
| 2,636,861 | 4/1953 | Watson | 252/78.5 |
| 3,074,889 | 1/1963 | Attwood et al. | 252/78.5 |
| 3,125,529 | 3/1964 | Simmons et al. | 252/78.5 |
| 3,707,500 | 12/1972 | Romano et al. | 252/78.5 |
| 3,956,154 | 5/1976 | Marolewski et al. | 252/78.5 |

*Primary Examiner*—Harris A. Pitlick

*Attorney, Agent, or Firm*—Blanchard, Flynn, Thiel, Boutell & Tanis

[57] ABSTRACT

A fire-resistant hydraulic fluid comprises (a) a phosphate triester derived from phenol, alkyl-substituted phenol or an alkanol, provided that the carbon atom number ratio of the aliphatic groups to the total of the ester is less than 0.25, and (b) 0.5 to 10% by weight, based on the weight of the triester, of an aliphatic polyester derived from an alkanedibasic acid having 3 to 24 carbon atoms and an alkylene glycol having 2 to 10 carbon atoms, said polyester having a molecular weight of 5,000 to 50,000. The fluid has an improved fire resistance and a high viscosity index.

12 Claims, 3 Drawing Figures

PHOSPHATE ESTER-BASED FIRE RESISTANT HYDRAULIC FLUID CONTAINING AN ALIPHATIC POLYESTER

This is a continuation, of application Ser. No. 879,962, filed Feb. 21, 1978 now abandoned.

BACKGROUND OF THE INVENTION

1. Field of the Invention

The present invention relates to a fire-resistant hydraulic fluid. More particularly, the invention relates to fire-resistant hydraulic fluid comprising the combination of a specific phosphoric acid triester and a specific polyester.

2. Description of Prior Arts

Fire-resistant hydraulic fluid of the phosphoric acid ester type has heretofore been commonly used as a fire-resistant hydraulic fluid, and it is composed mainly of a mixture of triaryl esters of phosphoric acid, the aryl group of which is phenol and lower alkyl-substituted phenols such as cresol, ethylphenol, dimethylphenol and isopropylphenol. A triaryl phosphate from phenol or cresol is excellent in the fire resistance, but the viscosity is so low that it cannot be used alone as a hydraulic fluid. Accordingly, such triaryl phosphate derived from phenol or cresol is used in combination with another triaryl phosphate such as derived from ethylphenol, dimethylphenol and isopropylphenol so as to have a desired viscosity suitable for a hydraulic fluid. However, these conventional hydraulic fluids have the following defects:

(1) The viscosity index is very low.

(2) The fire resistance is lower than that of a triester of phosphoric acid formed by using phenol or cresol alone.

(3) A tri-o-alkyl-substituted phenyl phosphate is inevitably included, whereby there is a likelihood of toxicity.

Among characteristic properties of a hydraulic fluid, the viscosity is very important. If the viscosity is too low, abrasion and leakage in a pump increase and the volumetric efficiency of the pump is reduced, resulting in the occurrence of seizure. When the viscosity is too high, the torque efficiency of the pump is lowered and so the pump does not work properly. It is said that a viscosity suitable for operation of, for example, a vane pump should be in the range from 20 to 400 centi-stokes. The viscosity of the fluid is greatly under influenced by environmental conditions, especially by the operating temperature. A fluid having a viscosity which may easily change depending on the operating conditions, especially temperature, that is, a fluid having a low viscosity index, can be used only in a narrow range of temperatures, and therefore the maintenance of the fluid is needed. Conventional fire-resistant hydraulic fluids of the phosphoric acid ester type are composed mainly of mixtures of triaryl phosphates derived from various alkyl-substituted phenols, and one of their defects is a low viscosity index.

It is known that in order to increase the viscosity in ordinary lubricating fluids, a thickener is added, and that a viscosity index improver is added in order to enhance the viscosity index. In the case of fire-resistant hydraulic fluids of the phosphoric acid ester type, however, there is observed a special phenomenon that the fire resistance is degraded by addition of a thickener such as a polyether or polyester.

SUMMARY OF THE INVENTION

We have made research works for a long time with a view to development of hydraulic fluid having an excellent fire resistance and a high viscosity index, and it has been found that when a specific amount of a specific aliphatic polyester is incorporated into a specific phosphate triester, such an excellent hydraulic fluid can be obtained. Based on this finding, we have now completed the present invention.

More specifically, in accordance with the present invention, there is provided a fire-resistant hydraulic fluid composition comprising (a) a phosphate triester or a mixture thereof which is derived from phosphoric acid and an alcohol or a mixture thereof including phenol, alkyl-substituted phenols and alkanols, provided that the proportion of the number of carbon atoms in the aliphatic groups to the total number of carbon atoms in the whole triester is less than 0.25, and (b) 0.5 to 10% by weight, based on the weight of the triester, of an aliphatic polyester derived from an alkane-dibasic acid having 3 to 24 carbon atoms and an alkylene glycol having 2 to 10 carbon atoms, said polyester having a molecular weight of 5,000 to 50,000.

As the alkyl substituent group on the phenol, there may be used methyl, ethyl, propyl, butyl, pentyl, hexyl and their isomeric groups. As to the alkanol, there may be used methanol, ethanol, propanol, butanol and their isomers. It is preferable in this invention to use as said phosphate triester a triaryl phosphate where the aryl groups are especially cresyl groups or a mixture of cresyl and phenyl groups. In this invention, the carbon atom ratio as defined above is preferably less than 0.16. Furthermore, it is also preferable that an amount of the aliphatic polyester is 0.5 to 5% by weight based on the weight of the triester.

As to the cresyl group of the present invention, there can be of course mentioned o-, m- and p-cresyl groups and their mixtures. A triaryl phosphate synthesized from phenol (triphenyl phosphate) has a relatively high freezing point as a hydraulic fluid. Accordingly, a triaryl phosphate synthesized from cresol (tricresyl phosphate) is preferred. When a mixture of phenol and cresol is employed as the moiety of the ester, it is preferred that the phenol content be up to 65%, more preferably up to 50%. A triaryl phosphate synthesized from orthocresol may be toxic to the nerve system. Accordingly, it is preferred to use a triaryl phosphate having no nerve toxicity and prepared from ortho isomer-free cresol.

The aliphatic polyester that is used in the present invention is one derived from an alkane-dibasic acid having 3 to 24 carbon atoms, preferably 6 to 20 carbon atoms, and an alkylene glycol having 2 to 10 carbon atoms, preferably 3 to 5 carbon atoms, and it has a molecular weight of 5,000 to 50,000. As the alkane-dibasic acid, there can be mentioned succinic acid, adipic acid, sebacic acid and synthetic alkanedibasic acids having 12 to 24 carbon atoms. As the alkylene glycol, there can be mentioned, for example, ethylene glycol, propylene glycol, 1,3-butane diol, neopentyl glycol, hexylene glycol and 1,4-butane diol. The molecular weight is in the range of from 5,000 to 50,000, preferably 10,000 to 30,000. If the molecular weight is too low, the thickening effect is also low, and if the molecular weight is too high, the shear stability is unsatisfactory. In the polyester, terminal free carboxyl or hydroxyl groups may be left as they are, but they can be blocked with an aliphatic alcohol or fatty acid having 6 to 18 carbon atoms.

The amount added of the polyester is 0.5 to 10% by weight, preferably from 0.5 to 5%, more preferably 1 to 4% by weight. If the amount of the polyester is too large, the fire-resistance is reduced, and if the amount of the polyester is too small, either the viscosity or the viscosity index is not improved.

One of the characteristic features of the present invention is that, although a phosphate triester derivative has not heretofore been used alone as a hydraulic fluid because of its low viscosity, in the present invention use of such a phosphate triester is made possible. When phosphate triesters derived from phenol or various alkyl-substituted phenols are evaluated with respect to the fire-resistance based on the spontaneous ignition temperature, they are ranked as follows: phenyl ≧ cresyl > dimethylphenyl ≧ ethylphenyl > isopropylphenyl ≧ diisopropylphenyl > nonylphenyl. Thus, as the carbon number is the substituent alkyl group increases, the fire resistance becomes low. As is seen from the foregoing, by the fire-resistance hydraulic fluid composition of the present invention comprising a phosphate triester, it is made possible to improve its fire resistance remarkably over conventional hydraulic fluids of the phosphoric acid ester type.

Another characteristic feature of the fire-resistant hydraulic fluid composition of the present invention is that the viscosity index is very high. In conventional, commercially available, fire-resistant hydraulic fluids of the phosphoric acid ester type composed mainly of triaryl phosphates derived from various lower alkyl-substituted phenol mixtures, the viscosity index is very low and is generally in the range of from -10 to 10, and products having a viscosity of 30 to 70 cst at 37.8° C. are ordinarily marketed. Also phosphate triesters of the present invention have a viscosity index in the range of about -10 to about 10, which is equivalent to the viscosity index of commercially available fire-resistant hydraulic fluids of the phosphoric acid type, and the viscosity grade is 15 to 25 cst at 37.8° C., which is too low for use as a hydraulic fluid. On the contrary, in the composition of the present invention, the viscosity index can be increased to 100 or more, and a product having a viscosity of 40 to 60 cst at 37.8° C. can be obtained.

Also the process for preparing this novel fire-resistant hydraulic fluid composition of this invention is novel.

There is provided a process for preparing a fire-resistant hydraulic fluid which comprises the steps including: reacting an alcohol or a mixture thereof selected from the group consisting of phenol, alkyl-substituted phenols and alkanols, provided that the proportion of the number of carbon atoms in the aliphatic groups to the total number of carbon atoms in the aliphatic triester is less than 0.25, with a phosphorizing agent; separately preparing an aliphatic polyester solution from an alkane-dibasic acid having 3 to 24 carbon atoms and an alkylene glycol having 2 to 10 carbon atoms so that the polyester may have a molecular weight of 5,000 to 50,000; continuously distilling off the solvent of said polyester solution; adding a part of the obtained phosphate triester to the polyester solution while the solvent still remains in the solution and then distilling off the solvent completely.

For example, a preparation using phenol or cresol will be illustrated below.

A triaryl ester is prepared by reacting phenol or cresol with a phosphorizing agent such as phosphorus pentoxide ($P_2O_5$) and phosphoryl chloride ($POCl_3$) according to a known method.

In general, an aliphatic polyester is prepared by subjecting an alkane-dibasic acid and an alkylene glycol to dehydrating condensation in an aromatic hydrocarbon solvent such as benzene, toluene or xylene, in the presence of an acid catalyst, under heating and reduced pressure, while removing water formed by the reaction by distillation, and the reaction product is diluted with a mineral oil to obtain a product. When a solution of a polyester in a mineral oil or an oil component capable of dissolving the polyester therein is desired, this process can be conveniently adopted. However, since fire resistance is required for the composition of the present invention, this process is not preferred in practising the present invention. A polyester recovered by removal of water and the solvent by distillation has too high a viscosity, and its handling is very difficult.

We made research works with a view to developing a process capable of providing with ease a fire-resistance hydraulic fluid comprising a triaryl phosphate and an aliphatic polyester. As a result, it was found that this object can be attained conveniently by a process for the preparation of fire-resistant hydraulic fluid compositions, which comprises the steps of (1) subjecting an alkane-dibasic acid having 3 to 24 carbon atoms and an alkylene glycol having 2 to carbon atoms to dehydrating condensation in a solvent to form a polyester having a molecular weight of 5,000 to 50,000, (2) continuously distilling off the solvent and adding a part of the necessary amount of a triaryl phosphate derived from cresol or a mixture of cresol and phenol to the reaction mixture while the solvent is still left in the reaction mixture, and (3) distilling off the solvent completely.

According to the process of the present invention, a polyester having a very high viscosity is mixed with a triaryl phosphate which is a liquid having a boiling point much higher than the solvent while the solvent is still left in the polyester, and then, the solvent, which is an unnecessary component, is removed by distillation. Accordingly, filtration, purification and handling can be remarkably facilitated. Further, the fire resistance is not degraded at all.

It is preferred that in the final product, the polyester is incorporated in an amount of 0.5 to 10% by weight based on the triaryl phosphate. A sufficient amount of the triaryl phosphate may be added prior to removal of the solvent, but it is preferred to adopt a method in which a part of the triaryl phosphate is first added and after complete removal of the solvent, the triaryl phosphate is further added to attain a predetermined concentration (or viscosity). The amount of the triaryl phosphate first added is changed according to the molecular weight of the polyester, but in general, it is preferred that the triaryl phosphate be first added in an amount corresponding to 1/10 to 5 (on the weight base) of the amount of the polyester.

The present invention will now be described in detail by reference to the following Examples that by no means limit the scope of the invention.

EXAMPLE 1

[Process for Preparation of Polyester]

A reaction vessel was charged with 500 parts by weight of sebacic acid, 270 parts of weight of neopentyl glycol, 22 parts of stearic acid (manufactured and sold under tradename "Lunac S-40" by Kao Soap K.K.), 0.2 part by weight of titanium oxide and 50 parts of xylene, and reaction was continued at 180° to 220° C. under reflux of xylene while removing water by azeotropic distillation. The advance and completion of the reaction were determined based on the acid value, hydroxyl value and viscosity. The reaction was conducted for 40 hours to obtain a polyester having a molecular weight of 10,000.

[Preparation of Hydraulic Fluid Composition]

After the synthesis of the above polyester, the temperature of the liquid reaction mixture was lowered to 100° to 120° C., and 170 parts by weight of tricresyl phosphate synthesized from a mixture of m- and p-cresols alone was added. The mixture was then agitated and xylene was completely removed by tillation. In another vessel, 850 parts by weight of the so prepared concentration solution of the polyester was incorporated in 16150 parts by weight of the same tricresyl phosphate as described above, to obtain 17000 parts by weight of a hydraulic fluid composition according to the present invention. The final polyester concentration was 4% by weight. Properties of the so obtained hydraulic fluid composition are shown in Table 1. For comparison, also properties of a commercially available fire-resistant hydraulic fluid composed mainly of a triaryl phosphate synthesized from a lower alkyl-substituted phenol are shown in Table 1.

TABLE 1

| Properties | Hydraulic Fluid of Present Invention | Commercially Available Fire-Resistant Hydraulic Fluid |
|---|---|---|
| specific gravity (15/4° C.) | 1.14 | 1.15 |
| pour point (°C.) | −30 | −22.5 ~ −30 |
| flash point (°C.) | 248 | 240 ~ 252 |
| compression ratio ($cm^2/kg \times 10^5$) | 2.9 | 2.8 ~ 3.0 |
| kinetic viscosity (cSt) | | |
| 37.8° C. | 56.5 | 49.06 |
| 98.9° C. | 8.18 | 5.195 |
| viscosity index | 125 | 10 |
| Shell four ball scar diameter (mm) | 0.41 | 0.39 |
| ratio (%) of o-alkyl-substituted phenol in alkyl-substituted phenol | below 0.1 | 3 ~ 32% |

[Evaluation of Fire Resistance]

Figure 1:
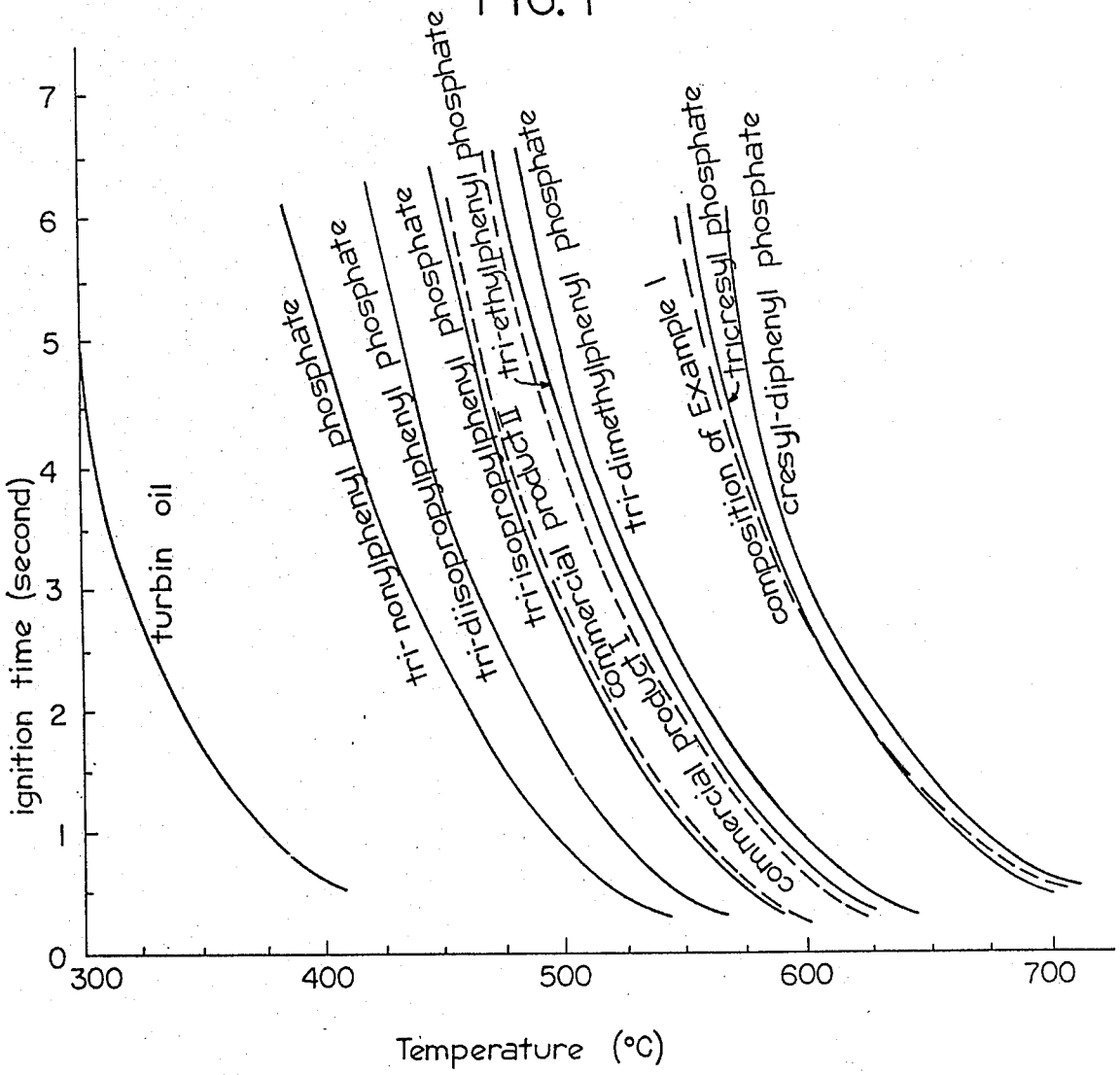
FIGS. 1, 2 and 3 illustrate effects of embodiments of this invention.

The fire resistance of each fluid is determined by the following method. A constant amount of a fluid (for instance, 0.07 ml) is dropped onto the bottom of a flask held in an electric furnace of a constant temperature, and the period of time when the ignition takes place after the droplet touches on the bottom is measured. Results are shown in FIG. 1. When the temperature of the flask was 600° C., ignition took place within 1 second in case of a commercial phosphate, but in case of a hydraulic fluid of the present invention, the ignition did not take place for about 3 seconds. When the flask temperature was 500° C., the commercial product was ignited in about 5 seconds, but the hydraulic fluid of the present invention was not ignited at all. The cause of ignition is that a sample touches on the bottom of the heated flask and therefore it is thermally decomposed and the concentration of generated, combustible gases increases in the flask. The hydraulic fluid of the present invention was very stable at the temperature of about 500° C. and hence, a rate of the decomposition is very low. Therefore, it is believed that the generated combustible gases diffuse and are diluted before its temperature rises to the combustion temperature.

EXAMPLE 2

[Preparation of Polyester]

In the same manner as described in Example 1, various polyesters were synthesized by using various alkane-dibasic acids and alkylene glycols shown in Table 2. The polyester synthesized in Example 1 is indicated as sample B in Table 2. It is seen that tri-diisopropylphenyl phosphate cannot provide the improved fire resistance, because it has a carbon atom ratio of 0.50 and so is outside the invention.

TABLE 2

| Sample | Alkane-Dibasic Acid | Alkylene Glycol | Termination | Molecular Weight |
|---|---|---|---|---|
| Present Invention | | | | |
| A | adipic acid | 1,3-butane diol | lauric acid | 7000 |
| B | sebacic acid | neopentyl glycol | stearic acid | 10000 |
| C | adipic acid | neopentyl glycol | — | 13000 |
| D | sebacic acid | neopentyl glycol | — | 17000 |
| E | $C_{12}$–$C_{18}$ alkano-dibasic acid | propylene glycol | higher alcohol | 24000 |
| F | sebacic acid | propylene glycol | — | 35000 |
| G | " | 1,3-butane diol | — | 48000 |
| Comparison | | | | |
| X | adipic acid | propylene glycol | 2-ethylhexanol | 2400 |
| Y | sebacic acid | 1,3-butane diol | — | 80000 |

[Preparation of Hydraulic Fluid Composition]

In the same manner as described in Example 1, various hydraulic fluid compositions were prepared by using the polyesters shown in Table 2.

From the viewpoint of easy handling of the resulting concentrated polyester solution, it is preferred that the amount of the phosphoric acid ester added before distillation of the xylene solvent is larger. However, if the amount of the phosphoric acid ester added before distillation of the solvent is too large, the output of the polyester per reaction vessel is reduced and the manufacturing efficiency is lowered. In Example 1, since the molecular weight of the polyester was 10,000, the amount of the phosphoric acid ester added before distillation of the solvent was adjusted to ¼ of the amount of the polyester. However, when the molecular weight of the polyester was 30,000, good results were obtained when the phosphoric acid ester was added in an amount about 2 times the amount of the polyester. Viscosity characteristics of the resulting hydraulic fluid compositions are shown in Table 3.

TABLE 3

| Polyester Sample | Polyester Concentration (% by weight) | Kinetic Viscosity (cSt) 37.8° C. | Kinetic Viscosity (cSt) 98.9° C. | Viscosity Index ASTM D2270 |
|---|---|---|---|---|
| Present Invention | | | | |
| A | 4.8 | 43.3 | 6.42 | 107 |
| C | 4.0 | 51.8 | 7.31 | 111 |
| D | 2.5 | 53.7 | 7.75 | 120 |
| E | 4.9 | 45.7 | 6.80 | 114 |
| F | 2.0 | 54.6 | 8.06 | 127 |
| G | 1.5 | 52.5 | 7.75 | 124 |
| Comparison | | | | |
| X | 15.8 | 52.2 | 7.33 | 111 |
| Y | 0.9 | 58.4 | 7.70 | 107 |

[Viscosity]

Figure 2:
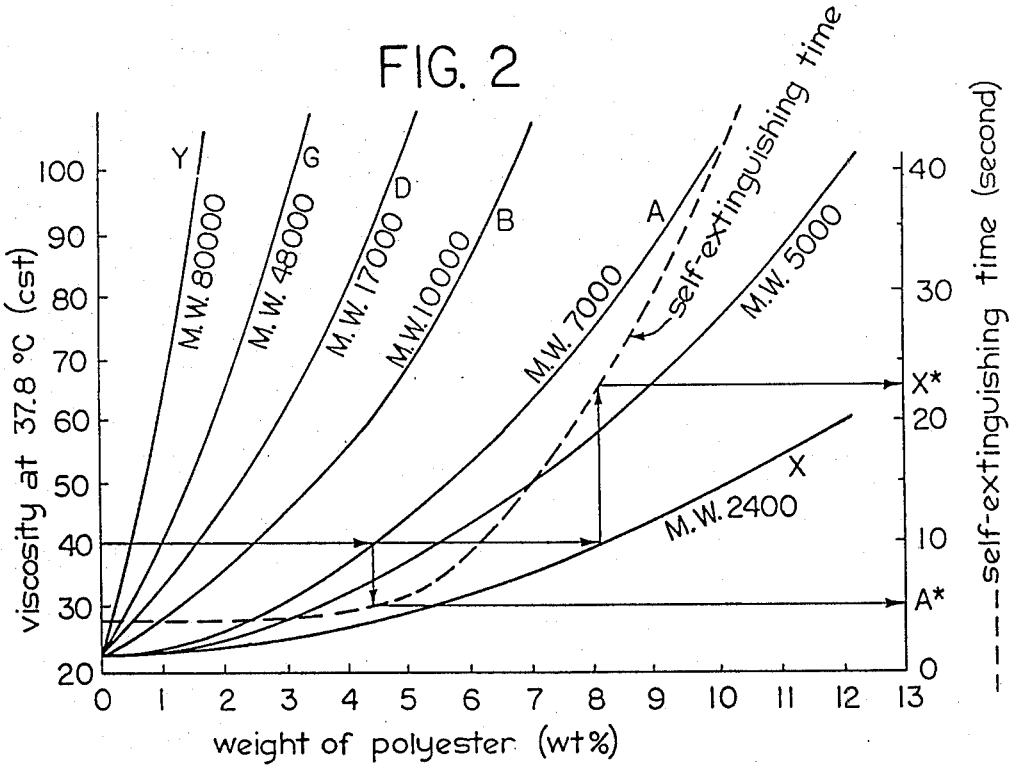

The foregoing polyesters were added to tricresyl phosphate and the relation between the amount added (% by weight) and the viscosity (cSt) at 37.8° C. was examined to obtain results shown in FIG. 2 (solid lines). In order to attain a sufficient fire resistance, it is required that the amount added of the polyester added is limited to up to 10% and the viscosity of the hydraulic fluid is in the range of from 30 to 70 cSt. In view of the foregoing, it will readily be understood that the molecular weight of the polyester should be at least 5,000.

[Fire Resistance]

The polyester was added to tricresyl phosphate and the relation between the amount added (% by weight) and the self-extinguishing time (seconds) was examined to obtain results shown in FIG. 2 (dot lines). The self-extinguishing time was determined according to the following wick combustion method.

Wick Combustion Method

A wick of glass wool was impregnated with a sample fluid and the wick was exposed to a flame of a propane burner for 30 seconds to effect combustion. Then, the wick was removed from the flame and the time required for extinguishment was measured.

Self-extinguishment of fire is a very important property of a phosphate-type fire resistant hydraulic fluid, and the shorter the time for extinguishment is, the better it is. As shown in FIG. 2, the self-extinguishing time becomes longer as the concentration of the polyester, especially when the molecular weight is in the lower side, is higher.

Self-extinguishing time of commercial hydraulic fluids of phosphate type usually lies between 10 to 40 seconds. To be equivalent to those of commercial ones, the maximum dosage of the polyester of this invention is limited up to about 10%. To be better than the commercial ones, the dosage, preferably, is less than 5%.

Incidentally, in FIG. 2, when it is intended to obtain a hydraulic fluid having a viscosity of 40 cSt, in case of the polyester sample A, the intended object of this invention can be attained by incorporation of about 4.5% of the polyester and in this case, the self-extinguishing time is about 5 seconds (indicated by A*). In case of the polyester sample X, an amount of the polyester incorporated should be increased to about 8%, and in this case, the self-extinguishing time is 23 second (indicated by X*).

[Shear Stability Test]

Sample fluids:

Various polyesters differing in the molecular weight were separately added to tricresyl phosphate so that the viscosity at 37.8° C. was 50 cSt.

Test Conditions:

A sample fluid (50 ml) was exposed to ultrasonic vibrations of 300 W and 20 KC for 10 minutes while the fluid temperature was adjusted to 20° to 30° C.

Viscosity Reduction Ratio (%):

The viscosity reduction ratio was calculated according to the following formula:

$$VRR\ (\%) = (V_1 - V_2)/V_1 \times 100$$

wherein VRR stands for the viscosity reduction ratio or viscosity loss ratio, $V_1$ denotes the viscosity at 37.8° C. before exposure to ultrasonic vibrations, and $V_2$ denotes the viscosity at 37.8° C. after exposure to ultrasonic vibration.

Figure 3:
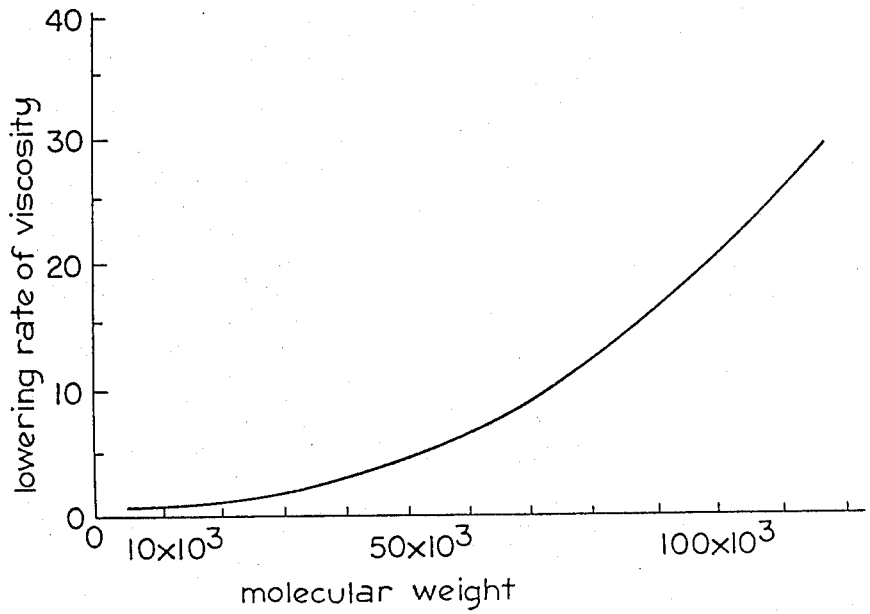

Obtained results are shown in FIG. 3. From the results shown in FIG. 3, it will readily be understood that in order to maintain the viscosity reduction ratio within a range causing no practical disadvantages, namely below 5%, it is necessary that the molecular weight of the polyester should be not higher than about 50,000, preferably not higher than 30,000.

EXAMPLE 3

In accordance with the procedure as described in Example 1, polyester C as shown in Table 2 was again prepared with the molecular weight of 13,000 and in the form of its solution of concentration of 70 wt %. The solution was dissolved in respective fire resistant fluids comprising phosphate esters as shown in Table 4 so that the final concentration of the polyester introduced might be 8% by weight. Each resulting fire resistant composition was subject to the wick combustion method as defined and their self-extinguishing times were determined, as shown in Table 4.

TABLE 4

| base fluid | polyester wt % | self-extinguishing time second |
|---|---|---|
| cresyl-diphenyl phosphate | 0 | within 5 seconds |
| | 8 | within 6 seconds |
| trixylenyl phosphate | 0 | within 8 seconds |
| | 8 | within 8 seconds |
| triisopropylphenyl phosphate | 0 | within 10 seconds |
| | 8 | within 10 seconds |

It is not seen from the above that the used polyester having a molecular weight of about 13,000 reduced the fire resistance which the base fluid had.

The embodiments of the invention in which an exclusive property or privilege is claimed are defined as follows:

1. A fire-resistant hydraulic fluid consisting essentially of (a) a phosphate triester or a mixture thereof which is derived from phosphoric acid and an alcohol or a mixture thereof selected from the group consisting of phenol and alkyl-substituted phenols with the proviso that the ratio of the number of carbon atoms in the aliphatic hydrocarbon groups to the total number of carbon atoms in the triester is less than 0.16, and (b) 0.5 to 10% by weight, based on the weight of the phosphate triester, of an aliphatic polyester derived from an alkane-dicarboxylic acid having 3 to 24 carbon atoms and an alkylene glycol having 2 to 10 carbon atoms, said polyester having a molecular weight of 10,000 to 50,000.

2. A fluid as claimed in claim 1, in which said phosphate triester is a triaryl phosphate wherein the aryl groups are selected from the group consisting of cresyl groups and a mixture of cresyl and phenyl groups.

3. A fluid as claimed in claim 2, in which, in said mixture of cresyl and phenyl groups, the content of phenyl groups is up to 65%.

4. A fluid as claimed in claim 1, in which an amount of said polyester is from 0.5 to 5% by weight, based on the weight of the phosphate triester.

5. A fluid as claimed in claim 1, in which said alkanedicarboxylic acid has 6 to 20 carbon atoms and said alkylene glycol has 3 to 5 carbon atoms.

6. A fluid as claimed in claim 6 in which said phosphate triester is a triaryl phosphate wherein the aryl groups are selected from the group consisting of cresyl groups and a mixture of cresyl and phenyl groups, and said polyester has a molecular weight of 10,000 to 30,000 and the amount thereof is from 1 to 4% by weight, based on the weight of the phosphate triester, said fluid having a viscosity in the range of 30 to 70 cSt at 37.8° C.

7. A fluid as claimed in claim 1, in which said polyester has a terminal free carboxyl or hydroxyl group blocked with an aliphatic alcohol or fatty acid having 6 to 18 carbon atoms.

8. A fluid as claimed in claim 1, in which the molecular weight of said polyester is in the range of from 10,000 to 30,000.

9. A fluid as claimed in claim 1, in which said phosphate triester is tricresyl phosphate.

10. A fluid as claimed in claim 1, in which said alcohol is a mixture of m-cresol and p-cresol, being free from o-cresol.

11. A fluid as claimed in claim 1, prepared by adding a portion of said phosphate triester to an organic solvent solution of said polyester, and distilling off said organic solvent to obtain a concentrated solution of said polyester in said portion of said phosphate ester, and then adding the balance of said phosphate ester to said concentrated solution.

12. A fluid as claimed in claim 11 in which said portion of said phosphate ester is from 1/10 to 5 times, by weight, the weight of said polyester.

* * * * *

UNITED STATES PATENT AND TRADEMARK OFFICE

CERTIFICATE OF CORRECTION

PATENT NO. : 4 298 489

DATED : November 3, 1981

INVENTOR(S) : Kenjiro Ohba et al

It is certified that error appears in the above—identified patent and that said Letters Patent is hereby corrected as shown below:

Column 9, line 14; change "claim 6" to ---claim 5---.

Signed and Sealed this

*Thirtieth* Day of *March 1982*

[SEAL]

*Attest:*

GERALD J. MOSSINGHOFF

*Attesting Officer*

*Commissioner of Patents and Trademarks*